US011694839B2

(12) United States Patent
Sasajima et al.

(10) Patent No.: US 11,694,839 B2
(45) Date of Patent: Jul. 4, 2023

(54) BASE CONFIGURED AS AN ELECTRONIC COMPONENT OR A CIRCUIT BOARD

(71) Applicant: Murata Manufacturing Co., Ltd., Kyoto-fu (JP)

(72) Inventors: Namiko Sasajima, Nagaokakyo (JP); Hiroki Imaeda, Nagaokakyo (JP); Masami Okado, Nagaokakyo (JP); Shinji Otani, Nagaokakyo (JP); Tomohiro Sunaga, Nagaokakyo (JP); Yoshimasa Yoshioka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 456 days.

(21) Appl. No.: 16/890,947

(22) Filed: Jun. 2, 2020

(65) Prior Publication Data

US 2021/0020326 A1 Jan. 21, 2021

(30) Foreign Application Priority Data

Jul. 18, 2019 (JP) ..... 2019-132821

(51) Int. Cl.
*H01F 27/29* (2006.01)
*H01F 17/00* (2006.01)

(52) U.S. Cl.
CPC ..... *H01F 27/292* (2013.01); *H01F 17/0013* (2013.01)

(58) Field of Classification Search
CPC ..... H01F 27/292; H01F 27/29; H01F 17/0013
See application file for complete search history.

(56) References Cited

U.S. PATENT DOCUMENTS 6,373,368 B1 * 4/2002 Shikama ..... H01F 27/027 336/200
9,918,378 B1 * 3/2018 Shimodaira ..... H01L 23/49838
2012/0274433 A1 * 11/2012 Matsumoto ..... H01F 27/292 336/192
2015/0115776 A1 * 4/2015 Terashita ..... H01C 7/008 336/200
2017/0345550 A1 * 11/2017 Sasaki ..... H01F 27/292
2017/0345551 A1 * 11/2017 Yoshioka ..... H01F 17/04
2018/0337001 A1 * 11/2018 Tozawa ..... H01F 17/0013
2020/0286672 A1 * 9/2020 Yang ..... H01F 27/255

FOREIGN PATENT DOCUMENTS

JP S63122248 A * 5/1988
JP 2014013815 A 1/2014
JP 2018-082130 A 5/2018
JP 2019-075478 A 5/2019

* cited by examiner

*Primary Examiner* — Mang Tin Bik Lian
*Assistant Examiner* — Malcolm Barnes
(74) *Attorney, Agent, or Firm* — Studebaker & Brackett PC

(57) ABSTRACT

A base includes a main body and a multilayer metal film disposed on the main body. The multilayer metal film includes a first metal film disposed on the main body, the first metal film having conductivity, second metal film on the first metal film and above the main body, the second metal film having resistance to solder leaching, and a third metal film on the second metal film, the third metal film having wettability. The third metal film includes an inwardly extended portion extending between the second metal film and the main body.

20 Claims, 8 Drawing Sheets

BASE CONFIGURED AS AN ELECTRONIC COMPONENT OR A CIRCUIT BOARD

CROSS-REFERENCE TO RELATED APPLICATION

This application claims benefit of priority to Japanese Patent Application No. 2019-132821, filed Jul. 18, 2019, the entire content of which is incorporated herein by reference.

BACKGROUND

Technical Field

The present disclosure relates to a base.

Background Art

Hitherto, in bases, such as inductor components, multilayer metal films each including stacked metal layers have been used for internal electrodes included in electric elements and external terminals serving as terminals of electric elements. For example, Japanese Unexamined Patent Application Publication No. 2014-13815 discloses an inductor component including a substrate, a substantially spiral line disposed on each surface of the substrate, a magnetic layer covering the substantially spiral line, an external terminal disposed on a surface of the magnetic layer, and an extended line electrically connecting the substantially spiral line to the external terminal. The substantially spiral line is a multilayer metal film composed of an underlying Cu layer formed by an electroless plating process on the substrate and about two electroplated Cu layers formed by performing electroplating about twice on the underlying layer. The external terminal is formed by sputtering or screen printing before singulation and then plating treatment after the singulation.

SUMMARY

In the inductor component described in Japanese Unexamined Patent Application Publication No. 2014-13815, the multilayer metal film is disposed on the substrate or the magnetic layer as an example of a main body. The main body is composed of a sintered body of, for example, ferrite or alumina, a resin, or the like. The main body and the multilayer metal film are in close contact with each other at the interface of the dissimilar materials by a chemical or physical bonding force. Here, the base is subjected to thermal, electrical, and physical forces during production, mounting, use, and so forth. These forces may be accumulated as internal stress between the main body and the multilayer metal film to cause delamination. With a further reduction in the size of electronic components in the future, reductions in the size and thickness of main bodies and multilayer metal films may cause the delamination even under production, mounting, and use conditions that had no problems in the past.

Accordingly, the present disclosure provides a base having improved adhesion between a main body and a multilayer metal film.

According to an embodiment of the present disclosure, a base includes a main body and a multilayer metal film disposed on the main body. The multilayer metal film includes a first metal film disposed on the main body, the first metal film having conductivity, a second metal film on the first metal film and above the main body, the second metal film having resistance to solder leaching, and a third metal film on the second metal film, the third metal film having wettability and including an inwardly extended portion extending between the second metal film and the main body.

In the present specification, the expression "an A film is disposed above a B film" includes both of the following: the A film is disposed on the B film, in other words, the A film is disposed so as to be in direct contact with the B film; and the A film is disposed above the B film with a C film provided therebetween.

In this case, the third metal film having higher adhesion than the second metal film is disposed between the second metal film of the multilayer metal film and the main body, thus improving the adhesion between the main body and the multilayer metal film.

In the base, the main body may contain a magnetic metal powder, and an end edge of the inwardly extended portion may be located on the magnetic metal powder below the second metal film.

In this case, the main body contains the magnetic metal powder. Thus, the first metal film is strongly bonded to the magnetic metal powder in the main body by metallic bonding. The end edge of the inwardly extended portion is located on the magnetic metal powder below the second metal film. The inwardly extended portion is inhibited from extending between the main body and the first metal film. This can suppress a decrease in adhesion between the main body and the multilayer metal film.

In the base, the inwardly extended portion may have a thickness equal to or less than a portion of the third metal film other than the inwardly extended portion.

In this case, the inwardly extended portion has a relatively small thickness. This can suppress a decrease in adhesion due to the inwardly extended portion itself.

The base may further include a non-magnetic insulating film between the main body and the second metal film, in which the inwardly extended portion may extend between the second metal film and the insulating film.

In this case, the non-magnetic insulating film does not contain a magnetic metal material (specifically, for example, a magnetic metal powder). Thus, the adhesion between a first main surface and the second metal film is lower than that of a base that does not include the non-magnetic insulating film. As described above, the insulating film having relatively low adhesion to the multilayer metal film is disposed between the main body and the second metal film; thus, the inwardly extended portion extends easily between the second metal film and the insulating film.

In the base, the third metal film may contain a nobler metal than the first metal film and the second metal film.

In this case, the third metal film can be formed by a substitution reaction with the first metal film and the second metal film.

In the base, the first metal film may contain Cu. In this case, the conductivity of the multilayer metal film can be ensured at low cost. Additionally, the first metal film can have lower hardness; thus, the accumulation of internal stress in the multilayer metal film can be reduced.

In the base, the second metal film may contain Ni. In this case, resistance to solder leaching of the multilayer metal film can be easily improved.

In the base, the third metal film may contain Au. In this case, the chemical stability of the multilayer metal film can be easily improved in addition to wettability. Additionally, the third metal film can be easily formed by a substitution reaction.

The base may further include an inductor line disposed in the main body, in which the main body may contain a resin and a magnetic metal powder contained in the resin, the inductor line may be electrically coupled to the multilayer metal film, and the multilayer metal film may be included in an external terminal.

In this case, it is possible to provide the base serving as an inductor component having improved adhesion between the main body and the external terminal.

Other features, elements, characteristics and advantages of the present disclosure will become more apparent from the following detailed description of the present disclosure with reference to the attached drawings.

DETAILED DESCRIPTION

A base serving as an inductor component according to an aspect of the present disclosure will be described in detail below by an embodiment illustrated. The drawings include some schematic ones and do not always reflect actual dimensions or proportions.

First Embodiment

Structure

Figure 1A:
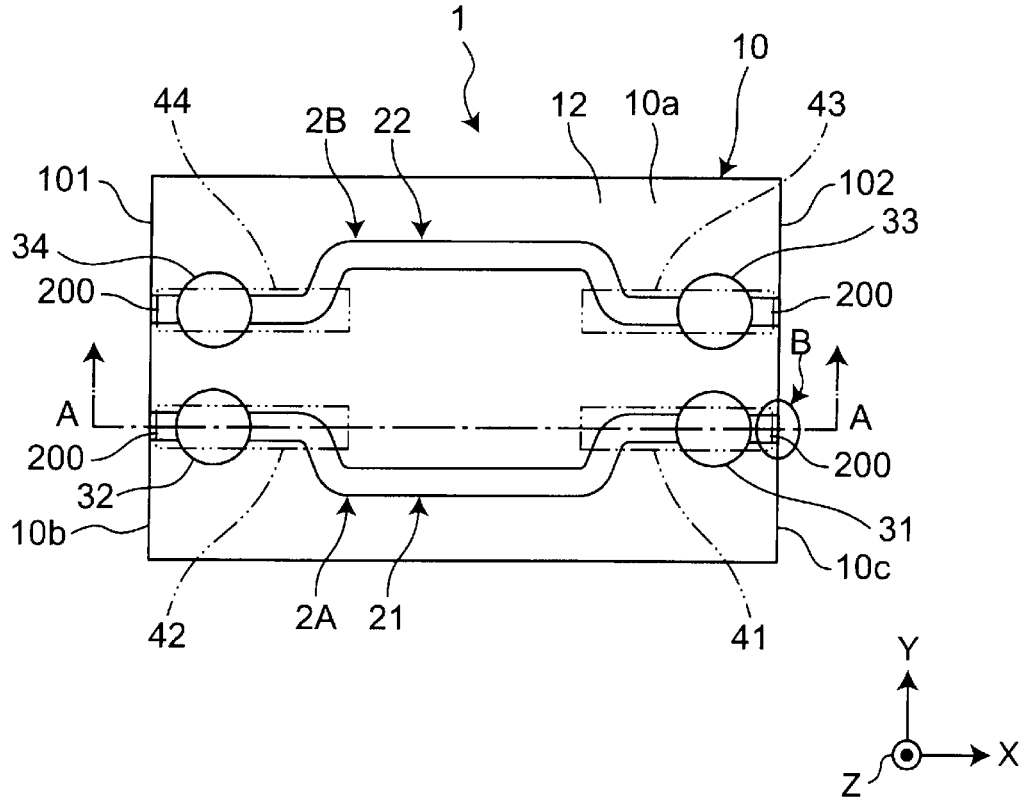
FIG. 1A is a perspective plan view of an inductor component according to a first embodiment.
Figure 1B:
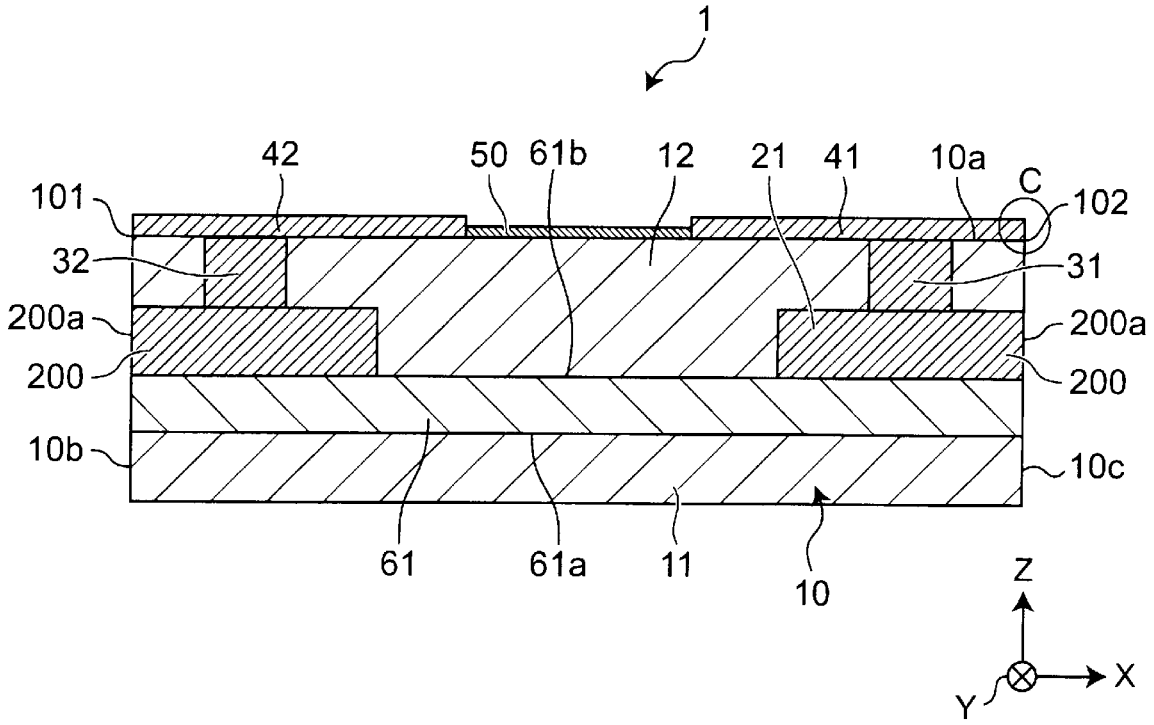
FIG. 1B is a cross-sectional view taken along line A-A.
Figure 2:
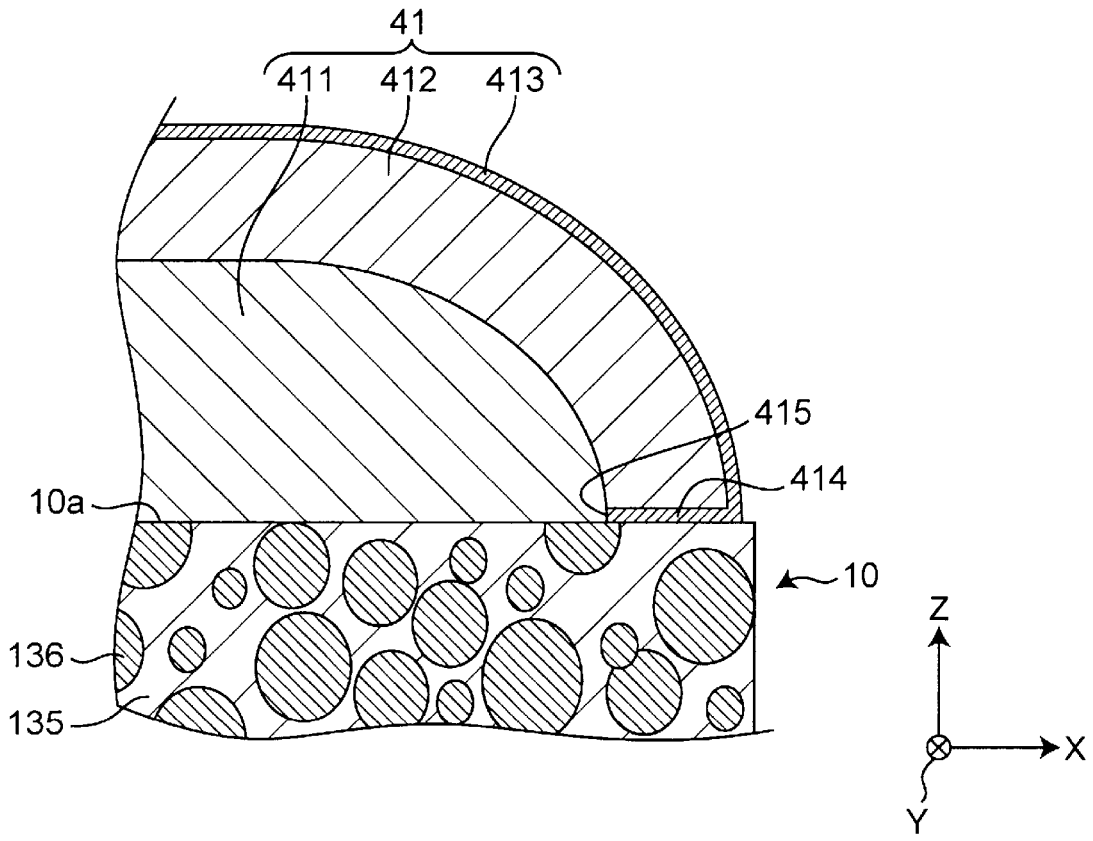
FIG. 2 is an enlarged view of portion C of FIG. 1B.
Figure 3:
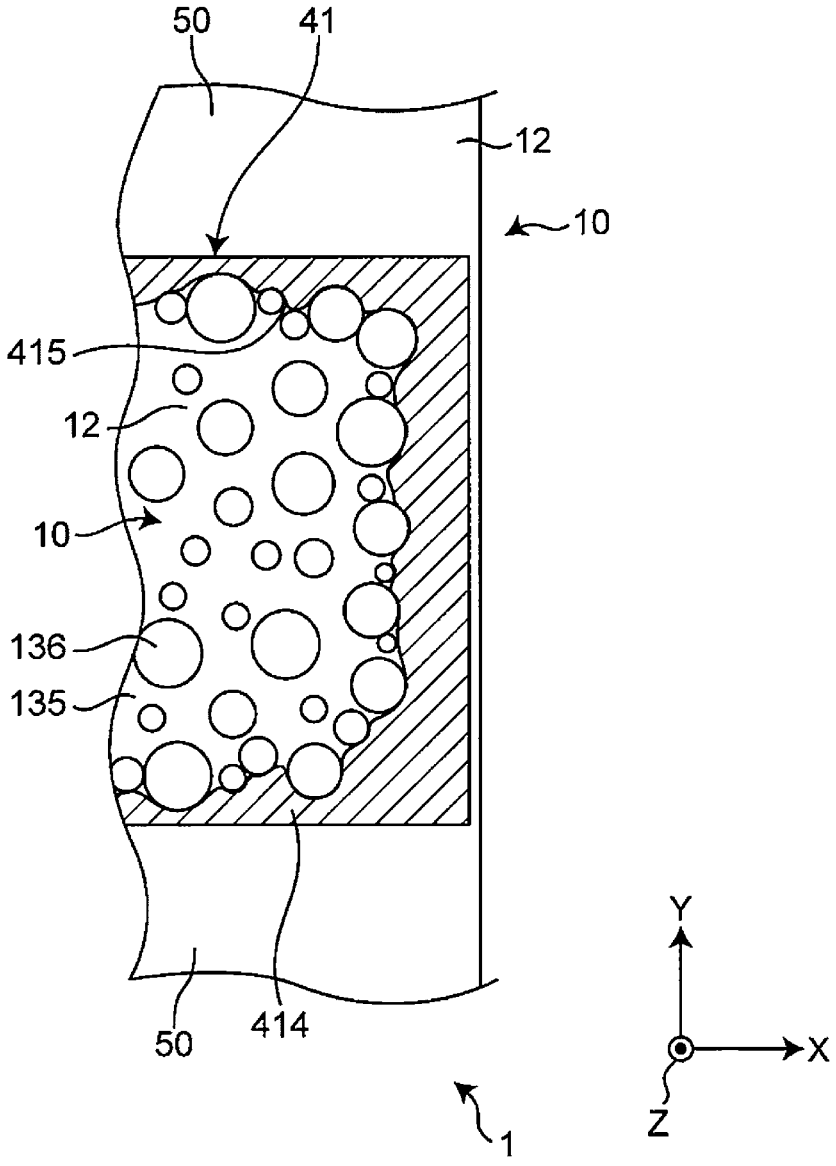
FIG. 3 is an enlarged view of portion B of FIG. 1A.

FIG. 1A is a perspective plan view of an inductor component according to a first embodiment. FIG. 1B is a cross-sectional view taken along line A-A of FIG. 1A. FIG. 2 is a partially enlarged view of FIG. 1B (enlarged view of portion C). FIG. 3 is partially enlarged view of FIG. 1A (enlarged view of portion B).

An inductor component 1 is, for example, a surface-mount electronic component mounted on a circuit board installed in an electronic device such as a personal computer, a digital versatile disc (DVD) player, a digital camera, a television (TV) set, a cellular phone, or an automotive electronic system. The inductor component 1, however, may be an electronic component built in a substrate instead of a surface-mount electronic component. The inductor component 1 is, for example, a substantially rectangular parallelepiped component as a whole. The shape of the inductor component 1 may be, but is not particularly limited to, a substantially cylindrical shape, a substantially polygonal columnar shape, a substantially truncated cone shape, or a substantially truncated polygonal pyramid shape.

As illustrated in FIGS. 1A and 1B, the inductor component 1 includes a main body 10, a first inductor device 2A and a second inductor device 2B disposed in the main body 10, a first substantially columnar line 31, a second substantially columnar line 32, a third substantially columnar line 33, and a fourth substantially columnar line 34 that are buried in the main body 10, an end face of each of the first to fourth substantially columnar lines 31 to 34 being exposed at a first main surface 10*a* of the main body 10, a first external terminal 41, a second external terminal 42, a third external terminal 43, and a fourth external terminal 44 that are disposed on the first main surface 10*a* of the main body 10, and an insulating film 50 disposed on the first main surface 10*a* of the main body 10. In the figure, a direction parallel to the thickness of the inductor component 1 is defined as a Z direction. The positive Z direction is defined as an upward direction. The negative Z direction is defined as a downward direction. In a plane perpendicular to the Z direction, a direction parallel to the direction of the length of the inductor component 1 is defined as an X direction, and a direction parallel to the direction of the width of the inductor component 1 is defined as a Y direction.

The main body 10 includes an insulating layer 61, a first magnetic layer 11 disposed on the lower surface 61*a* of the insulating layer 61, and a second magnetic layer 12 disposed on the upper surface 61*b* of the insulating layer 61. The first main surface 10*a* of the main body 10 corresponds to the upper surface of the second magnetic layer 12. The main body 10 has a three-layer structure including the insulating layer 61, the first magnetic layer 11, and the second magnetic layer 12. However, the main body 10 may have a single-layer structure consisting only of a magnetic layer, a two-layer structure consisting only of a magnetic layer and an insulating layer, or a four-or-more-layer structure consisting of multiple magnetic layers and an insulating layer.

The insulating layer 61 has insulating properties and is a layer having a substantially rectangular main surface. The insulating layer 61 has a thickness of, for example, about 10 μm or more and about 100 μm or less (i.e., from about 10 μm to about 100 μm). The insulating layer 61 is preferably, for example, an insulating resin layer composed of an epoxy resin or a polyimide resin free of a base material such as glass cloth from the viewpoint of reducing the profile. The insulating layer 61 is preferably an insulating resin layer composed of, for example, an epoxy resin or a polyimide resin free of a base material, such as glass cloth, from the viewpoint of reducing the profile. The insulating layer 61 may also be a sintered layer composed of a magnetic material, such as NiZn- or MnZn-based ferrite, or a non-magnetic material, such as alumina or glass, or may be a resin substrate layer containing a base material, such as a glass-epoxy material. When the insulating layer 61 is a sintered layer, the insulating layer 61 has high strength and good flatness, thus improving the processability of a stacked material on the insulating layer 61. Additionally, when the insulating layer 61 is a sintered layer, the insulating layer 61 is preferably ground, in particular, is preferably ground from the undersurface on which no material is stacked, from the viewpoint of reducing the profile.

Each of the first magnetic layer 11 and the second magnetic layer 12 has high magnetic permeability, is a layer having a substantially rectangular main surface, and contains a resin 135 and a magnetic metal powder 136 in the resin 135. The resin 135 is composed of an organic insulating material, such as an epoxy-based resin, bismaleimide, a liquid crystal polymer, or polyimide. The magnetic metal powder 136 is composed of a magnetic metal material such as an FeSi-based alloy, e.g., FeSiCr, an FeCo-based alloy, an Fe-based alloy, e.g., NiFe, or an amorphous alloy thereof. The magnetic metal powder 136 has an average particle size of, for example, about 0.1 μm or more and about 5 μm or less (i.e., from about 0.1 μm to about 5 μm). In a production process of the inductor component 1, the average particle size of the magnetic metal powder 136 can be calculated as a particle size (what is called "D50") corresponding to a 50% cumulative value in a particle size distribution determined by a laser diffraction/scattering method. The amount of the magnetic metal powder 136 contained is preferably about 20% or more by volume and about 70% or less by volume (i.e., from about 20% or more by volume to about 70% by volume) based on the entire magnetic layer. When the magnetic metal powder 136 has an average particle size of about 5 μm or less, the direct current superposition characteristics can be further improved. The use of the fine powder can reduce the iron loss at high frequencies. A magnetic powder composed of a NiZn- or MnZn-based ferrite may be used instead of the magnetic metal powder.

The first inductor device 2A and the second inductor device 2B include a first substantially spiral line 21 and a second substantially spiral line 22, respectively, disposed in parallel with the first main surface 10*a* of the main body 10. Thereby, the first inductor device 2A and the second inductor device 2B can be configured in a direction parallel to the first main surface 10*a* to achieve the low profile of the inductor component 1. The first substantially spiral line 21 and the second substantially spiral line 22 are disposed on the same plane in the main body 10. Specifically, the first substantially spiral line 21 and the second substantially spiral line 22 are disposed only on the upper side of the insulating layer 61, i.e., the upper surface 61*b* of the insulating layer 61, and are covered with the second magnetic layer 12.

Each of the first and second substantially spiral lines 21 and 22 is wound in a plane. Specifically, each of the first and second substantially spiral lines 21 and 22 has a substantially semi-elliptical arc shape when viewed from the Z direction. That is, each of the first and second substantially spiral lines 21 and 22 is a curved line wound about a half turn. Additionally, each of the first and second substantially spiral lines 21 and 22 includes a straight portion in its intermediate section. In the present disclosure, the term "spiral" of each substantially spiral line refers to a substantially curved shape including a substantially spiral shape wound in a plane and includes a substantially curved shape, such as the first substantially spiral line 21 or the second substantially spiral line 22, wound one turn or less. The substantially curved shape may partially include a straight portion.

Each of the first and second substantially spiral lines 21 and 22 preferably has a thickness of, for example, about 40 μm or more and about 120 μm or less (i.e., from about 40 μm to about 120 μm). In some embodiments, each of the first and second substantially spiral lines 21 and 22 has a thickness of about 45 μm, a line width of about 40 μm, and a line spacing of about 10 μm. The line spacing is preferably about 3 μm or more and about 20 μm or less (i.e., from about 3 μm to about 20 μm) from the viewpoint of achieving good insulating properties.

Each of the first and second substantially spiral lines 21 and 22 is composed of a conductive material and, for example, a low-electrical-resistance metal material, such as Cu, Ag, or Au. In this embodiment, the inductor component 1 includes only a single layer of the first and second substantially spiral lines 21 and 22. This can achieve the low-profile inductor component 1. Each of the first and second substantially spiral lines 21 and 22 may be formed of a multilayer metal film and, for example, may have a structure in which a conductive layer composed of, for example, Cu or Ag is disposed on an undercoat layer, composed of, for example, Cu or Ti, deposited by electroless plating.

The first substantially spiral line 21 has a first end portion and a second end portion that are electrically coupled to the first substantially columnar line 31 and the second substantially columnar line 32, respectively, located at outer side portions and is curved in a substantially arc from the first substantially columnar line 31 and the second substantially columnar line 32 toward the center of the inductor component 1. The first substantially spiral line 21 has pad portions having a larger line width than the substantially spiral shaped portion at both end portions thereof and is directly connected to the first and second substantially columnar lines 31 and 32 at the pad portions.

Similarly, the second substantially spiral line 22 has a first end portion and a second end portion that are electrically coupled to the third substantially columnar line 33 and the fourth substantially columnar line 34, respectively, located at outer side portions and is curved in a substantially arc from the third substantially columnar line 33 and the fourth substantially columnar line 34 toward the center of the inductor component 1.

Here, in each of the first and second substantially spiral lines 21 and 22, a range surrounded by a curve of the first or second substantially spiral line 21 or 22 and a straight line connecting both end portions of the first or second substantially spiral line 21 or 22 is defined as an inside diameter portion. The inside diameter portions of the first and second substantially spiral lines 21 and 22 do not overlap with each other, and the first and second substantially spiral lines 21 and 22 are separated from each other, when viewed from the Z direction.

Lines extend in a direction parallel to the X direction from connection positions of the first and second substantially spiral lines 21 and 22 and the first to fourth substantially columnar lines 31 and 34 and toward the outside of the inductor component 1. The lines are exposed outside the inductor component 1. That is, the first and second substantially spiral lines 21 and 22 have exposed portions 200 each exposed to the outside at a side surface parallel to the stacking direction of the inductor component 1 (a plane parallel to the Y and Z directions).

The lines are used to be coupled to a feeding line when additional electroplating is performed after the formation of the shapes of the first and second substantially spiral lines 21 and 22 in the production process of the inductor component 1. The use of the feeding line enables easy implementation of additional electroplating in a state of an inductor substrate before the singulation of the inductor substrate into individual inductor components 1, thereby reducing the distance between the lines. The implementation of the additional electroplating can reduce the distance between the first and second substantially spiral lines 21 and 22, thereby enhancing the magnetic coupling of the first and second substantially spiral lines 21 and 22, increasing the line width of the first and second substantially spiral lines 21 and 22 to reduce the electrical resistance, and reducing the outside shape of the inductor component 1.

The first and second substantially spiral lines 21 and 22 have the exposed portions 200 and thus can be highly resistant to electrostatic discharge damage during the processing of the inductor substrate. In each of the substantially spiral lines 21 and 22, the thickness (a dimension in the Z direction) of the exposed surface 200*a* of each exposed portion 200 is preferably equal to or less than the thickness (a direction in the Z direction) of the substantially spiral line 21 or 22 and about 45 μm or more. In the case where the thickness of the exposed surface 200*a* is equal to or less than the thickness of the substantially spiral line 21 or 22, the proportions of the magnetic layers 11 and 12 can be increased to improve the inductance. In the case where the thickness of the exposed surface 200*a* is about 45 μm or more, the occurrence of disconnection near the exposed surface 200*a* can be reduced. The exposed surface 200*a* is preferably formed of an oxide film. In this case, a short circuit can be suppressed between the inductor component 1 and its adjacent component.

The first to fourth substantially columnar lines 31 and 34 extend in the Z direction from the substantially spiral lines 21 and 22 and penetrate through the second magnetic layer 12. The first substantially columnar line 31 extends upward from the upper surface of one end portion of the first substantially spiral line 21. An end face of the first substantially columnar line 31 is exposed at the first main surface 10*a* of the main body 10. The second substantially columnar line 32 extends upward from the upper surface of the other end portion of the first substantially spiral line 21. An end face of the second substantially columnar line 32 is exposed at the first main surface 10*a* of the main body 10. The third substantially columnar line 33 extends upward from the upper surface of one end portion of the second substantially spiral line 22. An end face of the third substantially columnar line 33 is exposed at the first main surface 10*a* of the main body 10. The fourth substantially columnar line 34 extends upward from the upper surface of the other end portion of the second substantially spiral line 22. An end face of the fourth substantially columnar line 34 is exposed at the first main surface 10*a* of the main body 10.

The first substantially columnar line 31, the second substantially columnar line 32, the third substantially columnar line 33, and the fourth substantially columnar line 34 extend linearly from the first inductor device 2A and the second inductor device 2B to the end faces exposed at the first main surface 10*a* in a direction perpendicular to the end faces. Thereby, the first external terminal 41, the second external terminal 42, the third external terminal 43, and the fourth external terminal 44 can be coupled to the first inductor device 2A and the second inductor device 2B at a shorter distance, thus enabling the inductor component 1 to have lower resistance and higher inductance. The first to fourth substantially columnar lines 31 to 34 are composed of a conductive material and, for example, the same material as that of the first and second substantially spiral lines 21 and 22.

Each of the first to fourth external terminals 41 to 44 is formed of a multilayer metal film disposed on the first main surface 10*a* of the main body 10 (the upper surface of the second magnetic layer 12). The first external terminal 41 is in contact with the end face of the first substantially columnar line 31 exposed at the first main surface 10*a* of the main body 10 and electrically coupled to the first substantially columnar line 31. Thereby, the first external terminal 41 is electrically coupled to one end portion of the first substantially spiral line 21. The second external terminal 42 is in contact with an end face of the second substantially columnar line 32 exposed at the first main surface 10*a* of the main body 10 and electrically coupled to the second substantially columnar line 32. Thereby, the second external terminal 42 is electrically coupled to the other end portion of the first substantially spiral line 21.

Similarly, the third external terminal 43 is in contact with the end face of the third substantially columnar line 33 and electrically coupled to the third substantially columnar line 33, thereby electrically coupled to one end portion of the second substantially spiral line 22. The fourth external terminal 44 is in contact with the end face of the fourth substantially columnar line 34 and electrically coupled to the fourth substantially columnar line 34, thereby electrically coupled to the other end of the second substantially spiral line 22.

The first main surface 10*a* of the inductor component 1 has a first end edge 101 and a second end edge 102 that extend linearly and that correspond to sides of a substantially rectangular shape. The first end edge 101 and the second end edge 102 are end edges of the first main surface 10*a* connected to a first side surface 10*b* and a second side surface 10*c*, respectively, of the main body 10. The first external terminal 41 and the third external terminal 43 are arranged along the first end edge 101 adjacent to the first side surface 10*b* of the main body 10. The second external terminal 42 and the fourth external terminal 44 are arranged along the second end edge 102 adjacent to the second side surface 10*c* of the main body 10. The first side surface 10*b* and the second side surface 10*c* of the main body 10 extend in the Y direction and coincide with the first end edge 101 and the second end edge 102, respectively, when viewed from a direction perpendicular to the first main surface 10*a* of the main body 10. The arrangement direction of the first external terminal 41 and the third external terminal 43 is a direction connecting the center of the first external terminal 41 and the center of the third external terminal 43. The arrangement direction of the second external terminal 42 and the fourth external terminal 44 is a direction connecting the center of the second external terminal 42 and the center of the fourth external terminal 44.

The insulating film 50 is disposed on a portion of the first main surface 10*a* of the main body 10 where the first to fourth external terminals 41 to 44 are not disposed. However, end portions of the first to fourth external terminals 41 to 44 may extend on portions of the insulating film 50, so that the portions of the insulating film 50 may overlap the end portions of the first to fourth external terminals 41 to 44 in the Z direction. The insulating film 50 is composed of, for example, a resin material, such as an acrylic resin, an epoxy-based resin, or polyimide, having high electrical insulating properties. This can improve the insulation among the first to fourth external terminals 41 to 44. The insulating film 50 serves as a mask used for the pattern formation of the first to fourth external terminals 41 to 44 to improve the production efficiency. When the magnetic metal powder 136 is exposed at a surface of the resin 135, the insulating film 50 can cover the exposed magnetic metal powder 136 to prevent the exposure of the magnetic metal powder 136 to the outside. The insulating film 50 may contain a filler composed of an insulating material, such as silica or barium sulfate.

As illustrated in FIG. 2, the first external terminal 41 is formed of a multilayer metal film and includes a first metal film 411 in contact with the main body 10 (second magnetic layer), a second metal film 412 covering the first metal film 411 from a side of the first metal film 411 opposite to the main body 10, and a third metal film 413 disposed on the second metal film 412. The first external terminal 41 may further include catalytic layers. For example, the catalytic layers may be disposed between the first metal film 411 and second metal film 412 and between the second metal film 412 and the third metal film 413. The structures of second, third, and fourth external terminals 42, 43, and 44 are the same as the structure of the first external terminal 41. Thus, only the first external terminal 41 will be described below.

The first metal film 411 is electrically conductive and serves to reduce the electrical resistance of the first external terminal 41. The second metal film 412 has resistance to solder leaching and directly or indirectly covers the first metal film 411, thus suppressing the solder leaching of the first metal film 411 of the first external terminal 41 due to mounting solder. The third metal film 413 has wettability and can wet the first external terminal 41 with solder. The third metal film 413 includes an inwardly extended portion 414 extending between the second metal film 412 and the main body 10. That is, the inwardly extended portion 414 extends from an end portion of the first external terminal 41 toward the inside of the first external terminal 41.

Typically, metals having wettability have low hardness and soft, compared with metals having resistance to solder leaching. For this reason, such a metal having wettability is more likely to be in close contact with the first main surface 10*a* along its irregularities than a metal having resistance to solder leaching. Thus, the adhesion between the third metal film 413 and the main body 10 is higher than that between the second metal film 412 and the main body 10. For this reason, the third metal film 413 having wettability has higher adhesion to the first main surface 10*a* than the second metal film 412 having resistance to solder leaching. Thus, in the structure of the inwardly extended portion 414, the third metal film 413, which has higher adhesion to the first main surface 10*a* than the second metal film 412, is disposed between the second metal film 412 of the multilayer metal film and the main body 10. Accordingly, in this embodiment, the adhesion between the main body 10 and the multilayer metal film (first external terminal 41) is improved.

The inwardly extended portion 414 includes an end edge 415. As illustrated in FIGS. 2 and 3, the end edge 415 of the inwardly extended portion 414 is preferably located on the magnetic metal powder 136 below the second metal film 412. Because the main body 10 contains the magnetic metal powder 136, strong bonds are formed by metallic bonding between the first metal film 411 and the magnetic metal powder 136 in the main body 10. The end edge 415 of the inwardly extended portion 414 is located on the magnetic metal powder 136 below the second metal film 412. The inwardly extended portion 414 is blocked by the joining portion of the first metal film 411 and the magnetic metal powder 136 and is inhibited from extending between the main body 10 and the first metal film 411. Thus, when the end edge of the inwardly extended portion 414 is located on the magnetic metal powder 136 below the second metal film 412, a decrease in adhesion between the main body 10 and the first metal film 411 is suppressed. FIG. 3 illustrates a plane section taken at the inwardly extended portion 414 of the first external terminal 41. However, the first metal film 411 is not illustrated.

The inwardly extended portion 414 preferably has a thickness equal to or less than a portion of the third metal film 413 other than the inwardly extended portion 414. In this case, the thickness of the inwardly extended portion 414 can be reduced by setting the thickness of the inwardly extended portion 414 to a value equal to or less than the portion of the third metal film 413 other than the inwardly extended portion 414. As described above, because the inwardly extended portion 414 has a relatively small thickness, it is possible to suppress a decrease in adhesion due to the inwardly extended portion 414 itself.

The thickness of the portion of the third metal film 413 other than the inwardly extended portion 414 is preferably about one or more times the thickness of the inwardly extended portion 414. In this case, the thickness of the portion of the third metal film 413 (the portion of the third metal film 413 disposed on the second metal film 412) other than the inwardly extended portion 414 is a certain value or more. Thus, the third metal film 413 can ensure wettability.

The measurement conditions of the thickness (including measurements of thickness described below) are as follows: The measurements are performed by observing a scanning electron microscope (SEM) image of a cross section obtained by cutting a measurement object (in the above case, the first external terminal 41) at the center of a surface perpendicular to the measurement dimension (thickness) of the measurement object. Specifically, a sample, such as the inductor component 1, is processed to expose a cross section (for example, a section taken along line A-A of FIG. 1A) passing through the center of the multilayer metal film to be measured. An image of the cross section is captured with the SEM at a magnification of 10,000, and the thickness of the cross section is measured using the image. The thickness of the inwardly extended portion 414 and the thickness of the portion other than the inwardly extended portion 414 may each be obtained by measuring the thicknesses at five points excluding the end portions thereof and calculating the average value. The thicknesses described below are similarly calculated.

The first metal film 411 preferably contains Cu. In this case, the conductivity of the multilayer metal film can be ensured at low cost. Additionally, the first metal film 411 can have lower hardness; thus, internal stress in the first external terminal 41 including the first metal film 411 can be reduced. The first metal film 411 preferably has a larger thickness than other metal films in the first external terminal 41. In this case, the internal stress can be further reduced while the conductivity of the first external terminal 41 is improved. The first metal film 411 need not contain Cu and may contain at least one of Ag, Au, Al, Ni, Fe, and Pd.

A catalytic layer preferably contains Pd. In this case, the catalytic layer can be easily composed of a nobler metal than a metal contained in the first metal film 411. Furthermore, when the second metal film 412 is formed by electroless plating, the oxidation of a reducing agent, such as hypophosphorous acid, can be easily promoted to further promote the deposition of the second metal film 412. The catalytic layer need not contain Pd and may contain at least one of Ag, Cu, Pt, and Au. When the catalytic layer contains a nobler metal than the first metal film 411, the catalytic layer can be easily formed by a substitution reaction with the first metal film 411.

The second metal film 412 preferably contains Ni. In this case, the resistance to solder leaching of the second metal film 412 can be easily improved. This can also reduce the electrochemical migration of the first metal film 411. The second metal film 412 need not contain Ni and may contain at least one of Pd, Pt, Co, and Fe.

The third metal film 413 preferably contains Au. In this case, the chemical stability and the wettability of the third metal film 413 can be easily improved. Additionally, the third metal film 413 can be easily formed by a substitution reaction. The third metal film 413 need not contain Au and may contain at least one of Sn, Pd, and Ag. The third metal film 413 preferably contains a nobler metal than the first metal film 411 and the second metal film 412. In this case, the third metal film 413 can be formed by a substitution reaction with the first metal film 411 and second metal film 412.

Production Method

A method for producing the inductor component 1 will be described below.

Figure 4A:
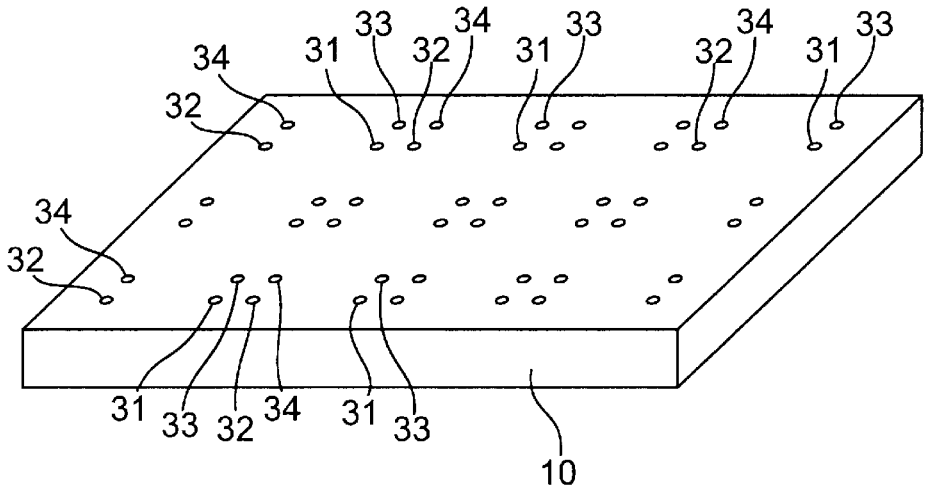
FIG. 4A is an explanatory view of a method for producing an inductor component.

As illustrated in FIG. 4A, the upper surface of the main body 10 is subjected to polishing processing, such as polishing, in a state in which the multiple substantially spiral lines 21 and 22 and the multiple substantially columnar lines 31 to 34 are covered with the main body 10. Thereby, the end faces of the substantially columnar lines 31 to 34 are exposed at the upper surface of the main body 10.

Figure 4B:
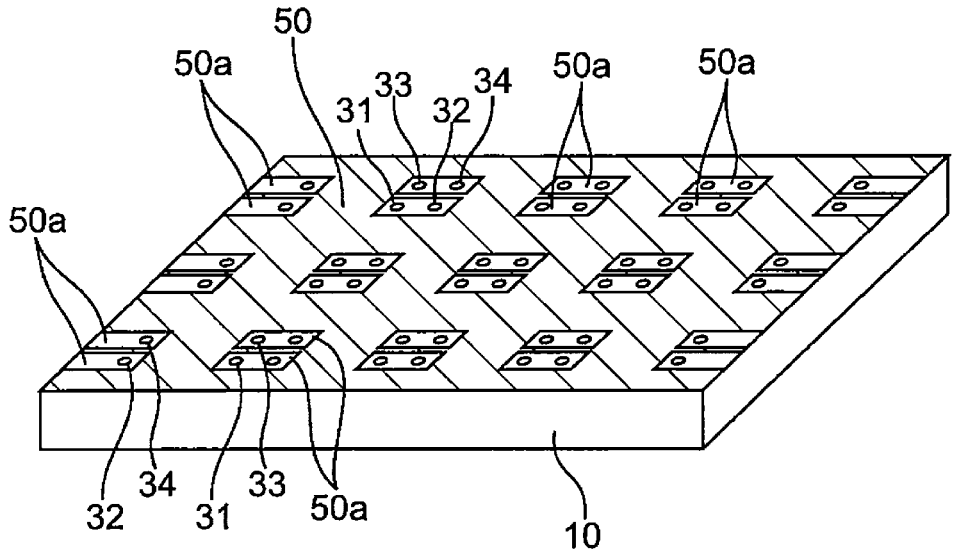
FIG. 4B is an explanatory view of the method for producing an inductor component.

As illustrated in FIG. 4B, the insulating film 50 represented by a hatch pattern is then formed on the entire upper surface of the main body 10 by, for example, a coating method, such as spin coating or screen printing, or a dry process, such as the affixation of a dry resist. The insulating film 50 is formed of, for example, a photosensitive resist. Subsequently, portions of the insulating film 50 are removed by, for example, photolithography, laser processing, drilling, or blasting in regions where external terminals are to be formed, thereby forming through-holes 50*a* at which end faces of the substantially columnar lines 31 to 34 and part of the main body 10 (second magnetic layer 12) are exposed. At this time, as illustrated in FIG. 4B, an end face of each of the substantially columnar lines 31 to 34 may be entirely or partially exposed at a corresponding one of the through-holes 50*a*. The end faces of the multiple substantially columnar lines 31 to 34 may be exposed at one of the through-holes 50*a*.

Figure 4C:
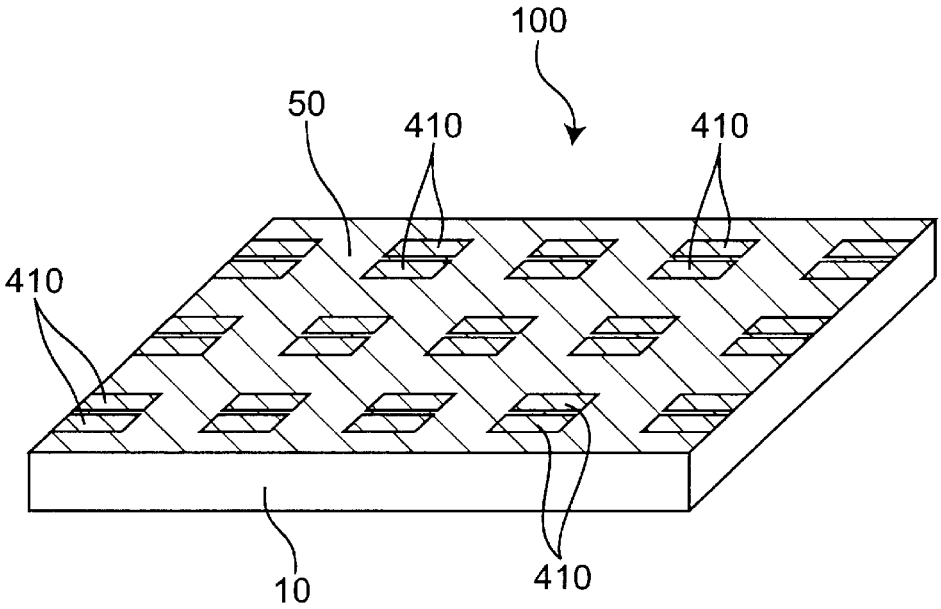
FIG. 4C is an explanatory view of the method for producing an inductor component.
Figure 4D:
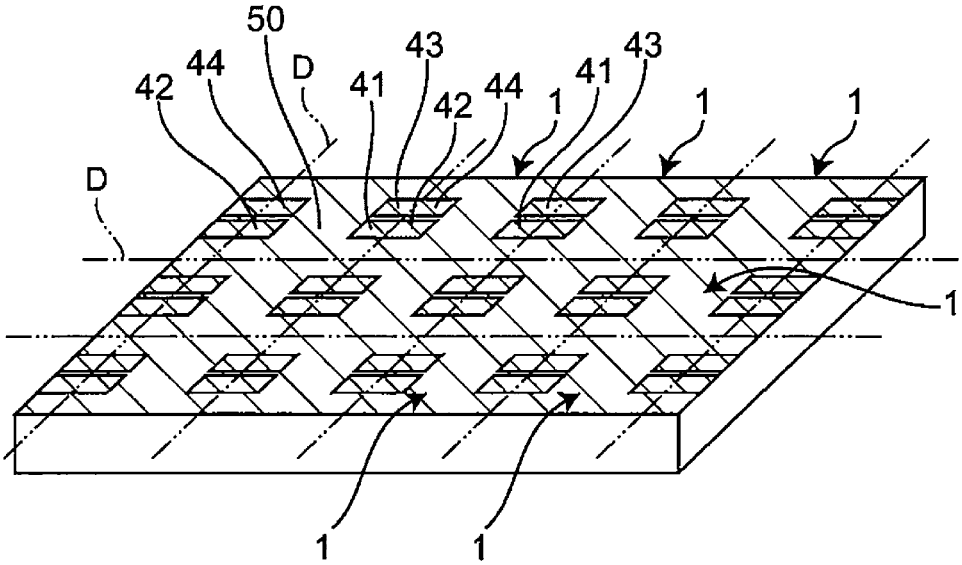
FIG. 4D is an explanatory view of the method for producing an inductor component.

As illustrated in FIG. 4C, multilayer metal films 410 represented by a hatch pattern are formed in the through-holes 50*a* to form a mother substrate 100. The multilayer metal films 410 constitute the external terminals 41 to 44 before cutting. Subsequently, as illustrated in FIG. 4D, the mother substrate 100, i.e., the sealed multiple substantially spiral lines 21 and 22, is cut along cut lines D with, for example, a dicing blade into pieces each including the two substantially spiral lines 21 and 22, thereby producing the multiple inductor components 1. The multilayer metal films 410 are cut along cut lines D to form the external terminals 41 to 44. A method for producing the external terminals 41 to 44 may be a method in which the multilayer metal films 410 are cut as described above or may be a method in which the insulating film 50 is removed in advance in such a manner that the through-holes 50*a* have the shape of the external terminals 41 to 44, and then the multilayer metal films 410 are formed.

A step of forming each multilayer metal film 410 is as follows: For example, the first metal film 411 is formed on the main body 10. The second metal film 412 is formed on the first metal film 411 and the main body 10. Then the third metal film 413 is formed on the second metal film 412. This step may further include a substep of forming the catalytic layer after the formation of the first metal film 411 and before the second metal film 412, and after the second metal film 412 and before the third metal film 413.

The first metal film 411 is formed by, for example, electroless plating but may be formed by electroplating. In the case where the first metal film 411 is formed by electroless plating, because the main body 10 contains the magnetic metal powder 136, a metal component to be formed into the first metal film 411 is precipitated by a substitution reaction with the magnetic metal powder 136 exposed at the main surface 10*a* of the main body 10, thereby forming the first metal film 411. This can improve the adhesion between the main body 10 and the first metal film 411.

The second metal film 412 is formed by, for example, electroless plating using a catalytic layer formed on the first metal film 411. The catalytic layer is formed by, for example, a substitution reaction with the first metal film 411.

The third metal film 413 is formed by, for example, electroless plating. The third metal film 413 is formed by, for example, a substitution reaction with the second metal film 412.

The formation of the inwardly extended portion 414 will be described below. In the method for producing the inductor component 1, after the formation of the second metal film 412, the third metal film 413 is formed. A material solution for the inwardly extended portion 414 enters the boundary between the second metal film 412 and the main body 10 by capillary action. As a result, the inwardly extended portion 414 is formed between the second metal film 412 and the main surface 10*a* of the main body 10. Because the main body 10 contains the magnetic metal powder 136, strong bonds are formed between the first metal film 411 and the magnetic metal powder 136 in the main body 10. Thus, the material solution for the inwardly extended portion 414 can enter the boundary between the main body 10 and the first metal film 411 until blocked by the joining portion of the first metal film 411 and the magnetic metal powder 136. As a result, the end edge of the inwardly extended portion 414 is located on the magnetic metal powder 136 below the second metal film 412. In this way, the inwardly extended portion 414 is formed.

The inwardly extended portion 414 is preferably formed so as to have a thickness equal to or less than the thickness of a portion of the third metal film 413 other than the inwardly extended portion 414. The use of the reduced thickness of the inwardly extended portion 414 can further improve the wettability of the inwardly extended portion 414. The thickness of the inwardly extended portion 414 can be adjusted by the formation time and other formation conditions of the third metal film.

The formation of the inwardly extended portion 414 can be promoted by, for example, the following methods:

1) a method for reducing a region of the magnetic metal powder 136 exposed at the main surface 10*a* of the main body 10;

2) a method for forming a film (specifically, an adhesion-inhibiting layer, such as an oxide film, or the insulating film 50) between the second metal film 412 and the main surface 10*a* of the main body 10 (see a second embodiment);

3) a method for imparting a gentle slope to the insulating film 50 described in item 2) (see a third embodiment); and 4) a method for reducing irregularities.

In the method described in item 1), the reduction of the region of the magnetic metal powder 136 exposed at the main surface 10*a* of the main body 10 makes it difficult to form strong bonds by metallic bonding between the main body 10 and the second metal film 412. This is intended to make it easy to permit the inwardly extended portion to extend to the boundary between the second metal film 412 and the main body 10 to increase a region where the inwardly extended portion 414 is easily formed. This can be achieved by reducing the amount of the magnetic metal powder 136 contained in a coating liquid for forming the main body 10 based on the amount of the resin 135 contained.

The method described in item 4) is, for example, a method for reducing the irregularities of the main surface 10*a* of the main body 10 in the method described in item 1) or a method for reducing the irregularities of a surface of the film or the insulating film 50 in each of the methods described in items 2) and 3). The former method can be performed by adjusting polishing conditions of the formation of the main surface 10*a*. The latter method can be performed by, for example, adjusting the viscosity and drying conditions of a coating liquid for forming the insulating film 50.

Second Embodiment

Figure 5:
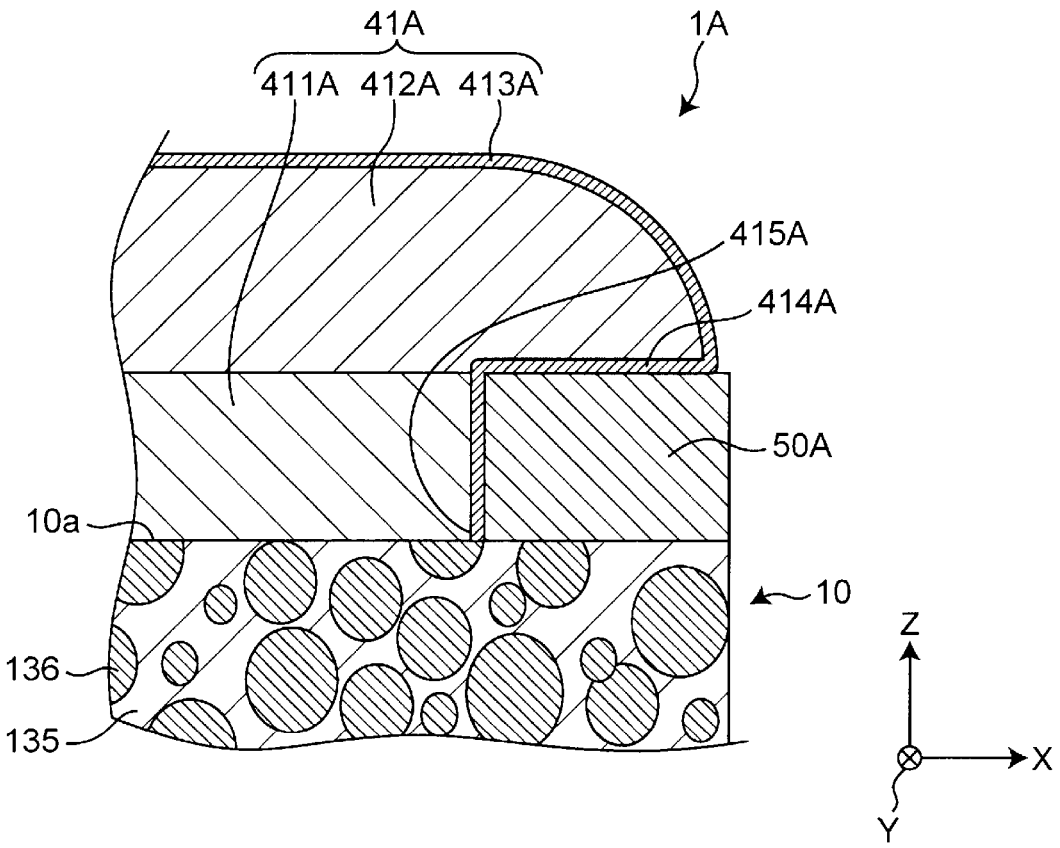
FIG. 5 is an enlarged cross-sectional view of an inductor component according to a second embodiment.

FIG. 5 is an enlarged cross-sectional view of an inductor component 1A according to a second embodiment and is a partially enlarged view (enlarged view of portion C) of a modified embodiment of the component illustrated in FIG. 1B. The second embodiment is different from the first embodiment in that a non-magnetic insulating film 50A is further disposed between the main body 10 and a second metal film 412A. The different structure will be described below. In the second embodiment, the same reference numerals as those in the first embodiment indicate the same elements as those in the first embodiment, and descriptions are not redundantly repeated.

Structure

As illustrated in FIG. 5, the inductor component 1A according to the second embodiment includes the non-magnetic insulating film 50A between the main body 10 and the second metal film 412A. The insulating film 50A is disposed on the same plane as a first metal film 411A and covered with the second metal film 412A. The first metal film 411A and the insulating film 50A preferably have the same thickness, and their upper surfaces are flash with each other. The cross-sectional shape of the insulating film 50A is substantially rectangular. The inwardly extended portion 414A extends between the second metal film 412A and the insulating film 50A. Furthermore, the inwardly extended portion 414A extends between the first metal film 411A and the insulating film 50A. The end edge 415A of the inwardly extended portion 414A is located on the magnetic metal powder 136 on the first main surface 10*a* of the main body 10.

In the case where the inductor component 1A includes the insulating film 50A between the main body 10 and the second metal film 412A, the inwardly extended portion 414A can be more reliably formed to suppress a decrease in adhesion between the main body 10 and a first external terminal 41A. The insulating film 50A does not contain a magnetic metal, such as the magnetic metal powder 136. For this reason, a strong bond, such as a metallic bond, is not formed between the first metal film 411A and the insulating film 50A and between the second metal film 412A and the insulating film 50A. The adhesion between the first main surface 10*a* and the second metal film 412 is lower than that of the base that does not include the non-magnetic insulating film 50A. That is, the insulating film 50A does not contain a magnetic metal and thus has low adhesion to the first main surface 10*a*. As described above, in the case where the insulating film 50A having a relatively low adhesion to the multilayer metal film is disposed between the main body 10 and the second metal film 412, the inwardly extended portion 414A extends easily between the second metal film 412 and the insulating film 50A. Thus, when a third metal film 413A is formed in a method for producing the inductor component 1A, the inwardly extended portion 414A extends between the second metal film 412A and the insulating film 50A and, furthermore, extends between the first metal film 411A and the insulating film 50A. The inwardly extended portion 414A is blocked by the joining portion of the first metal film 411A and the magnetic metal powder 136. The end edge of the inwardly extended portion 414A is located on the magnetic metal powder 136. In this way, the inwardly extended portion 414A is inhibited from extending between the main body 10 and the multilayer metal film. This can suppress a decrease in adhesion between the main body 10 and the multilayer metal film.

Production Method

In the method for producing the inductor component 1A, the first metal film 411A is formed in the step of forming the multilayer metal films 410 illustrated in FIG. 4C. At this time, the first metal film 411A is formed so as to have the same thickness as the insulating film 50A. Then the second metal film 412A is formed so as to cover the boundary between the first metal film 411A and the insulating film 50A. In this way, the insulating film 50A is disposed between the main body 10 and the second metal film 412A. Subsequently, the third metal film 413A is formed on the second metal film 412A. At this time, the insulating film 50A having a relatively low adhesion to the multilayer metal film is disposed between the main body 10 and the second metal film 412A; thus, the inwardly extended portion 414A extends easily between the second metal film 412A and the insulating film 50A. Additionally, a boundary is established between the insulating film 50A and the first metal film 411A, and adhesion at the boundary is relatively low. For this reason, the inwardly extended portion 414A also extends easily between the first metal film 411A and the insulating film 50A. As a result, the inwardly extended portion 414A extends between the second metal film 412A and the main body 10 and between the first metal film 411A and the insulating film 50A. In this way, the inwardly extended portion 414A is formed in such a manner that the end edge 415A is located on the magnetic metal powder 136 below the second metal film 412.

Third Embodiment

Figure 6:
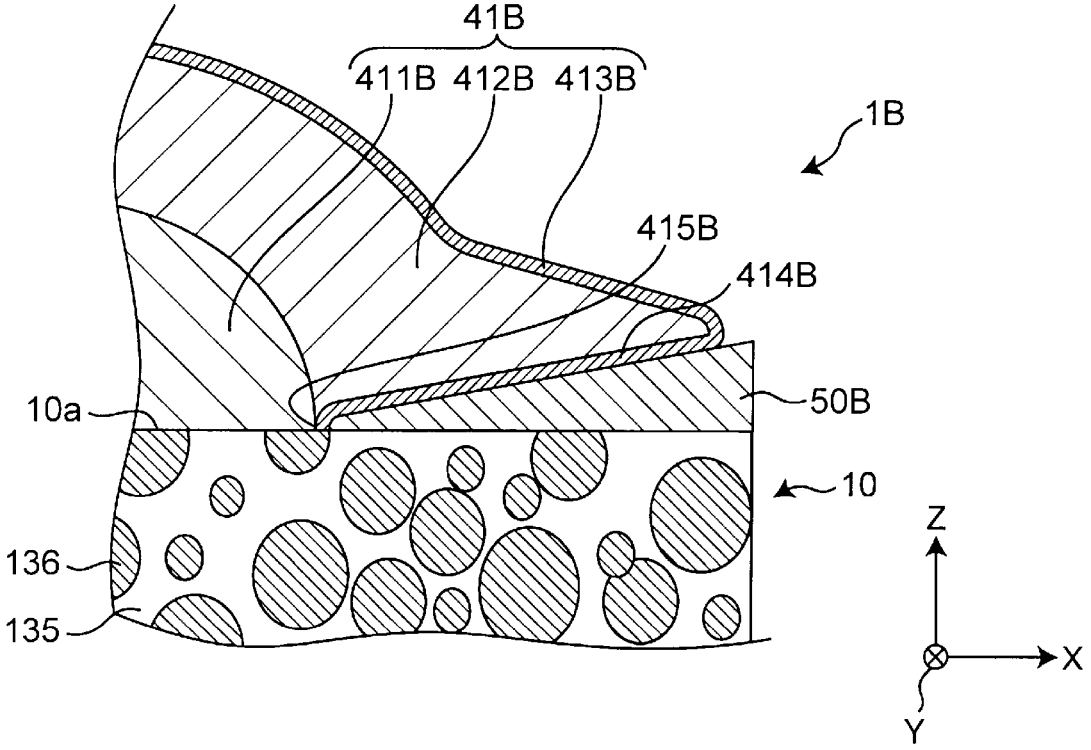
FIG. 6 is an enlarged cross-sectional view of an inductor component according to a third embodiment.

FIG. 6 is an enlarged cross-sectional view of an inductor component according to a third embodiment. The third embodiment is different from the second embodiment in that the sectional shape of an insulating film 50B has a gentle slope. The different structure will be described below. In the third embodiment, the same reference numerals as those in the first and second embodiments indicate the same elements as those in the first and second embodiments, and descriptions are not redundantly repeated.

As illustrated in FIG. 6, in an inductor component 1B according to the third embodiment, the insulating film 50B has a gentle slope toward a first metal film 411B. An inwardly extended portion 414B extends between a second metal film 412B and the insulating film 50B. The end edge 415B of the inwardly extended portion 414B is in contact with the first metal film 411B and the magnetic metal powder 136.

In the case of the insulating film 50B having a gentle slope toward the first metal film 411B, when a third metal film 413B is formed in the method for producing the inductor component 1B, the third metal film 413B extends more easily to the end portion of the second metal film 412B. Accordingly, in the case where the inductor component 1B includes the insulating film 50B, the third metal film 413B can be more reliably formed to further improve the adhesion between the main body 10 and a first external terminal 41B.

Production Method

In a method for producing the inductor component 1B, a step of forming a gentle slope of the insulating film 50B can be performed by, for example, adjusting the viscosity of a coating liquid for forming the insulating film 50B. The viscosity of the coating liquid can be adjusted by, for example, selecting the solvent of the coating liquid and the type and amount of resin contained.

The present disclosure is not limited to the foregoing embodiment, and can be changed in design without departing from the gist of the present disclosure. The features of the first to third embodiments may be variously combined.

In the foregoing embodiment, two of the first inductor device and the second inductor device are arranged in the main body. However, three or more inductor devices may be arranged. In this case, six or more external terminals and six or more substantially columnar lines are arranged.

In the foregoing embodiment, the number of turns of the substantially spiral line of each inductor component is less than about one. However, the substantially spiral line may be a curved line in which the number of turns of the substantially spiral line is more than about one. The number of layers of the substantially spiral lines in the inductor component is not limited to one, and a multilayer structure including two or more layers may be used. The arrangement of the first substantially spiral line of the first inductor device and the second substantially spiral line of the second inductor device is not limited to the structure in which the first and second substantially spiral lines are arranged on the same plane parallel to the first main surface and may be a structure in which the first and second substantially spiral lines are arranged in a direction perpendicular to the first main surface. The devices included in the main body of the inductor component are not limited to the substantially spiral lines. Known structures and shapes, such as substantially meandering patterns and substantially helical forms, may be used.

In the above-described embodiments, the multilayer metal film is used as the external terminal of each inductor component. Specifically, each inductor component further includes an inductor line disposed in the main body 10. The main body 10 contains the resin 135 and the magnetic metal powder 136 contained in the resin 135. The inductor line is electrically coupled to the multilayer metal film to permit the multilayer metal film to serve as an external terminal. Thereby, the inductor component has improved adhesion between the main body 10 and the multilayer metal film. The inductor line generates magnetic flux when a current flows, thereby imparting inductance to the inductor component. Examples of the structure and shape of the inductor line include known structures and shapes, such as the substantially spiral line.

In the above-described embodiments, although the multilayer metal film is used as the external terminal of each inductor component, the multilayer metal film is not limited thereto. For example, the multilayer metal film may be used as an internal electrode of the inductor component. The base is not limited to a base for an inductor component. The base may be another electronic component, such as a capacitor component or resistor component, and may be a circuit board incorporating these electronic components. That is, the multilayer metal film may be used as a line pattern of a circuit board.

The production conditions described above are merely examples, and are not limited as long as the inwardly extended portion can be obtained. Additionally, the inwardly extended portion can be formed by adjusting the surface roughness or the like of the insulating film 50B without being limited to the production conditions described above.

Example 1

Figure 7:
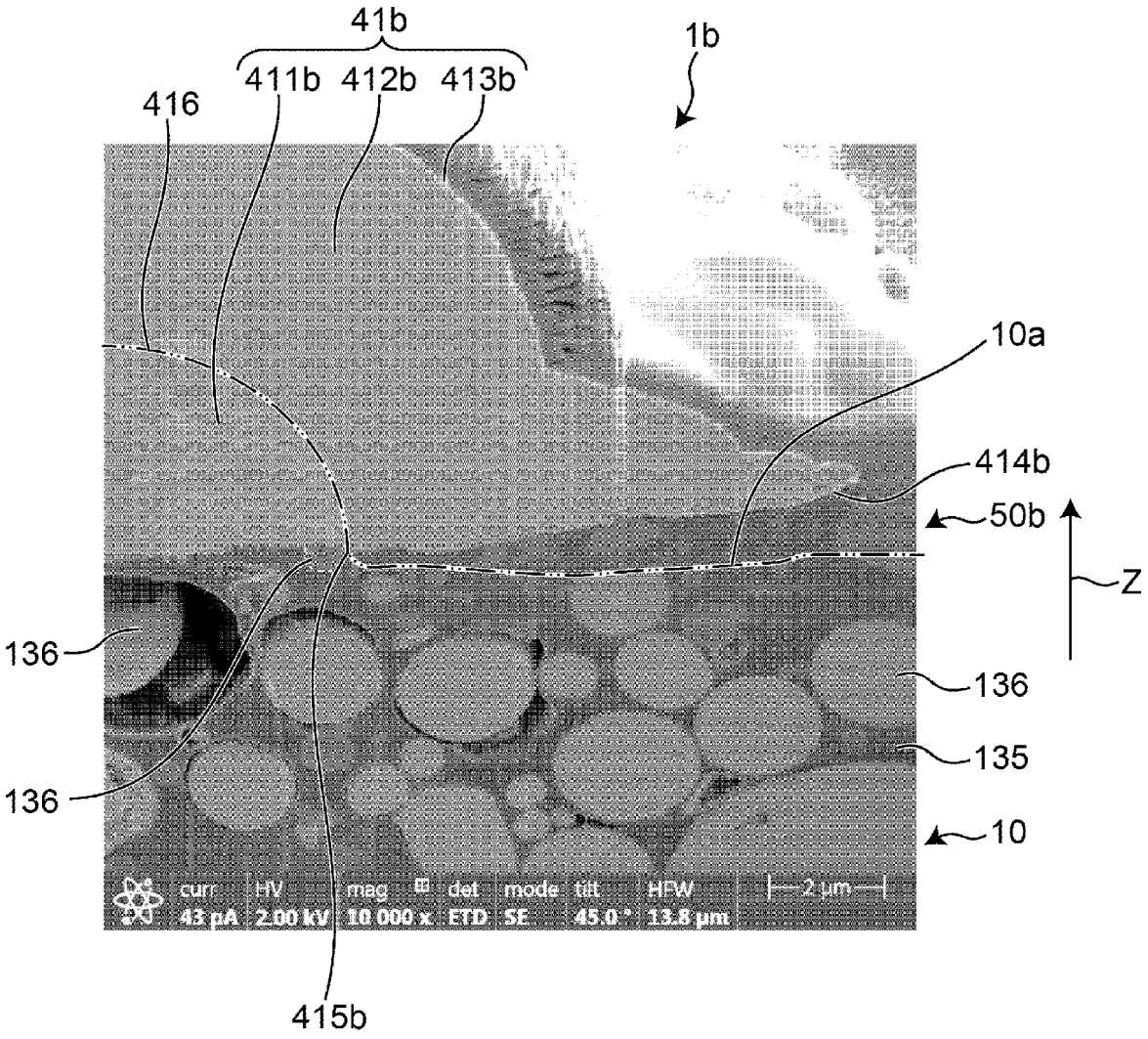
FIG. 7 is an image, captured by a scanning electron microscope, of an example of an inductor component.

FIG. 7 is a cross-sectional SEM image of an example of an inductor component 1*b* according to the third embodiment. FIG. 7 is an image of the inductor component 1*b* taken at the center thereof. As illustrated in FIG. 1A, this cross section is a cross section passing through the center of the metal film (cross section taken along line A-A). In FIG. 7, the upward direction is the Z direction.

A first metal film 411*b* is composed of Cu. A catalytic layer 416 is composed of Pd and disposed above the first metal film 411*b*. A second metal film 412*b* is composed of Ni and disposed on the catalytic layer 416 and above the main body 10. A third metal film 413*b* is composed of Au and disposed on the second metal film 412*b*. The third metal film 413*b* includes an inwardly extended portion 414*b*. The inwardly extended portion 414*b* extends from an end portion of a first external terminal 41*b* toward the inside of the first external terminal 41*b* and extends between the second metal film 412*b* and the main body 10. The end edge 415*b* of the inwardly extended portion 414*b* is located on the magnetic metal powder 136 below the second metal film 412*b*. The inductor component 1*b* includes an insulating film 50*b* between the main body 10 and the second metal film 412*b*. The insulating film 50*b* has a gentle slope toward the first metal film 411*b*. The inwardly extended portion 414*b* extends between the second metal film 412*b* and the insulating film 50*b*.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A base, comprising:

a main body; and a multilayer metal film disposed on the main body, the multilayer metal film including:

a first metal film disposed on the main body, the first metal film having conductivity;

a second metal film on the first metal film and above the main body, the second metal film having resistance to solder leaching; and a third metal film on the second metal film, the third metal film having wettability and including an inwardly extended portion extending between the second metal film and the main body, wherein first, second, and third surfaces of the inwardly extending portion are in direct contact with the main body, the first metal film, and the second metal film, respectively, without any intervening layer.

2. The base according to claim 1, wherein the main body contains a magnetic metal powder, and an end edge of the inwardly extended portion is located on the magnetic metal powder below the second metal film.

3. The base according to claim 1, wherein the inwardly extended portion has a thickness equal to or less than a portion of the third metal film other than the inwardly extended portion.

4. The base according to claim 1, further comprising:

a non-magnetic insulating film between the main body and the second metal film, wherein the inwardly extended portion extends between the second metal film and the insulating film.

5. The base according to claim 1, wherein the third metal film contains a nobler metal than the first metal film and the second metal film.

6. The base according to claim 1, wherein the first metal film contains Cu.

7. The base according to claim 1, wherein the second metal film contains Ni.

8. The base according to claim 1, wherein the third metal film contains Au.

9. The base according to claim 1, further comprising:

an inductor line disposed in the main body, wherein the main body contains a resin and a magnetic metal powder contained in the resin, the inductor line is electrically coupled to the multilayer metal film, and the multilayer metal film is included in an external terminal.

10. The base according to claim 2, wherein the inwardly extended portion has a thickness equal to or less than a portion of the third metal film other than the inwardly extended portion.

11. The base according to claim 2, further comprising:

a non-magnetic insulating film between the main body and the second metal film, wherein the inwardly extended portion extends between the second metal film and the insulating film.

12. The base according to claim 3, further comprising:

a non-magnetic insulating film between the main body and the second metal film, wherein the inwardly extended portion extends between the second metal film and the insulating film.

13. The base according to claim 2, wherein the third metal film contains a nobler metal than the first metal film and the second metal film.

14. The base according to claim 3, wherein the third metal film contains a nobler metal than the first metal film and the second metal film.

15. The base according to claim 4, wherein the third metal film contains a nobler metal than the first metal film and the second metal film.

16. The base according to claim 2, wherein the first metal film contains Cu.

17. The base according to claim 3, wherein the first metal film contains Cu.

18. The base according to claim 2, wherein the second metal film contains Ni.

19. The base according to claim 2, wherein the third metal film contains Au.

20. The base according to claim 2, further comprising:

an inductor line disposed in the main body, wherein the main body contains a resin and a magnetic metal powder contained in the resin, the inductor line is electrically coupled to the multilayer metal film, and the multilayer metal film is included in an external terminal.

* * * * *